US009219332B2

(12) United States Patent
Wendt

(10) Patent No.: US 9,219,332 B2
(45) Date of Patent: Dec. 22, 2015

(54) CONNECTING TERMINAL HAVING TOGGLE LEVER ACTUATION

(71) Applicant: Andreas Wendt, Berlin (DE)

(72) Inventor: Andreas Wendt, Berlin (DE)

(73) Assignee: PHOENIX CONTACT GMBH CO. KG, Blomberg (DE)

( * ) Notice: Subject to any disclaimer, the term of this patent is extended or adjusted under 35 U.S.C. 154(b) by 0 days.

(21) Appl. No.: 14/359,110

(22) PCT Filed: Nov. 22, 2012

(86) PCT No.: PCT/EP2012/004838

§ 371 (c)(1),
(2) Date: May 19, 2014

(87) PCT Pub. No.: WO2013/079176

PCT Pub. Date: Jun. 6, 2013

(65) Prior Publication Data

US 2014/0322957 A1 Oct. 30, 2014

(30) Foreign Application Priority Data

Nov. 29, 2011 (DE) ..... 10 2011 055 845

(51) Int. Cl.
*H01R 4/50* (2006.01)
*H01R 13/629* (2006.01)
*H01R 4/48* (2006.01)

(52) U.S. Cl.
CPC ..... *H01R 13/629* (2013.01); *H01R 4/489* (2013.01); *H01R 4/4818* (2013.01)

(58) Field of Classification Search
CPC .... H01R 11/24; H01R 4/5008; H01R 4/4845; H01R 4/4863
USPC ..... 439/838, 864, 835, 822, 729, 725, 819
See application file for complete search history.

(56) References Cited

U.S. PATENT DOCUMENTS

| | | | | |
|---|---|---|---|---|
| 4,723,921 | A | 2/1988 | Pooley | |
| 4,759,726 | A | 7/1988 | Naylor et al. | |
| 5,938,488 | A * | 8/1999 | Wilmes | 439/864 |
| 6,036,532 | A * | 3/2000 | Feistkorn | 439/495 |
| 2007/0141910 | A1 * | 6/2007 | Camino et al. | 439/610 |

FOREIGN PATENT DOCUMENTS

| | | |
|---|---|---|
| DE | 692481 A | 6/1940 |
| DE | 1965264 U | 8/1967 |
| DE | 1765856 B | 4/1971 |

(Continued)

*Primary Examiner* — Abdullah Riyami
*Assistant Examiner* — Thang Nguyen
(74) *Attorney, Agent, or Firm* — Leydig, Voit & Mayer, Ltd.

(57) ABSTRACT

A connecting terminal includes a receptacle body and a clamping element configured to clamp a conductor inserted into the connecting terminal against a current rail arranged in the connecting terminal in order to form a contact in a contacting state. The connecting terminal also includes a first lever arm rotatably mounted on the clamping element, a compression spring, and a second lever arm rotatably mounted on the compression spring. The second lever arm is configured to engage the first lever arm in the contacting state such that the first and second lever arms are guided together to tension the compression spring and transfer a spring force from the compression spring to the clamping element via the first and second lever arms.

11 Claims, 3 Drawing Sheets

(56) References Cited

FOREIGN PATENT DOCUMENTS

| | | | |
|---|---|---|---|
| DE | 19613557 | A1 | 6/1997 |
| DE | 29807956 | U1 | 7/1999 |
| DE | 19825629 | A1 | 12/1999 |
| DE | 202009010945 | U1 | 10/2009 |
| EP | 0955692 | B1 | 11/2001 |
| FR | 2506528 | A1 | 11/1982 |
| JP | 04303573 | A | 10/1992 |

* cited by examiner

CONNECTING TERMINAL HAVING TOGGLE LEVER ACTUATION

CROSS-REFERENCE TO RELATED APPLICATIONS

This application is a U.S. National Phase application under 35 U.S.C. §371 of International Application No. PCT/EP2012/004838, filed on Nov. 22, 2012, and claims benefit to German Patent Application No. DE 10 2011 055 845.4, filed on Nov. 29, 2011. The International Application was published in German on Jun. 6, 2013, as WO 2013/079176 A1 under PCT Article 21 (2).

FIELD

The invention relates to a connecting terminal having a toggle lever actuation.

BACKGROUND

Such a connecting terminal is known from DE 298 07 956 U1 for example. This has a housing, inside which a connecting contact is arranged in a fixed manner. Furthermore, the connecting terminal has a clamping spring, which has a first leg arranged such that it is supported on the connecting contact, and a free spring leg, which merges into a clamping end via a bending toggle, the clamping end having a clamping edge reaching underneath the connecting contact. Inside the housing an actuator, which grips onto the spring leg of the clamping spring, is pivotally mounted and in a clamped position releases the spring leg such that the clamping edge of its clamping end pulls a conductor, which has been inserted into the housing, against the connecting contact and presses the spring leg down in an open position such that the clamping edge is raised from the connecting contact in order to insert a conductor. The actuating element has a first lever arm and a second lever arm, the first lever arm being pivotally fixed to the second lever arm. A free end of the first lever arm is pivotally mounted inside the housing and a free end of the second lever arm is coupled to the spring leg.

The disadvantage with this connecting terminal is the increased requirement for installation space. Moreover, the assembly of such a connecting terminal is time consuming.

SUMMARY

In an embodiment, the present invention provides a connecting terminal comprising a receptacle body and a clamping element configured to clamp a conductor inserted into the connecting terminal against a current rail arranged in the connecting terminal so as to form a contact in a contacting state. The connecting terminal also includes a first lever arm rotatably mounted on the clamping element, a compression spring, and a second lever arm rotatably mounted on the compression spring. The second lever arm is configured to engage the first lever arm in the contacting state such that the first and second lever arms are guided together to tension the compression spring and transfer a spring force from the compression spring to the clamping element via the first and second lever arms.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
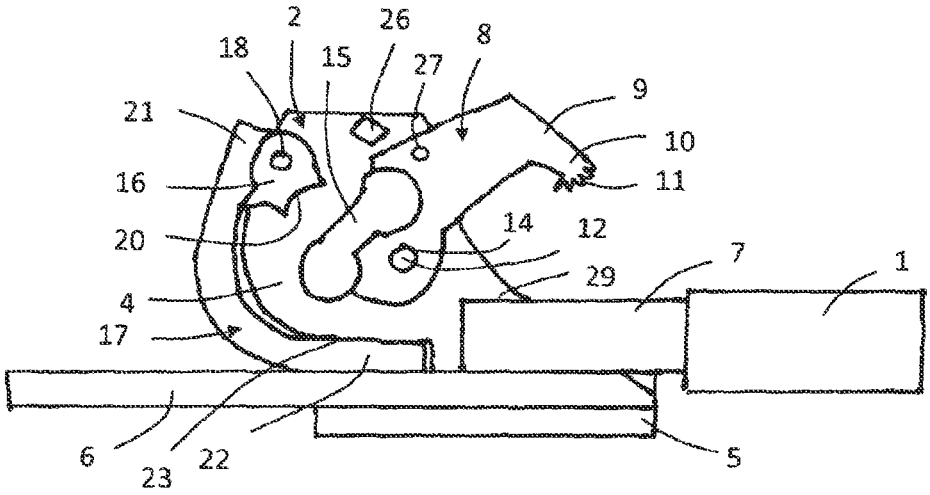
FIG. 1 shows a schematic, partially sectional view of a connecting terminal according to the invention in a first position.

An aspect of the present invention reduces the assembly time and installation space requirement of a connecting terminal while at the same time achieving a more reliable clamping of a conductor inserted into the connecting terminal.

In an embodiment, the invention provides a connecting terminal which has a receptacle body, a clamping element, a first lever arm, a second lever arm and a compression spring, the first lever arm being rotatably mounted on the clamping element and the second lever arm being rotatably mounted on the compression spring, wherein in a contacting state, in which a conductor inserted into the connecting terminal by means of the clamping element is clamped against a current rail arranged in the connecting terminal in order to form a contact, the first lever arm engages in the second lever arm and said lever arms are guided together such that the compression spring is tensioned and a spring force is transferred from the compression spring to the clamping element via the first lever arm and the second lever arm.

The connecting terminal according to an embodiment of the invention includes a toggle lever actuation, which is easy to assemble and only requires minimal installation space. A conductor inserted into the connecting terminal is clamped against a current rail inserted into the connecting terminal by means of the clamping element in order to form a contact. The clamping force of the clamping element onto the inserted conductor is produced by the compression spring, the clamping force being transferred from the compression spring onto the clamping element via the two lever arms. For that reason, the two lever arms are arranged between the compression spring and the clamping element, the first lever arm being rotatably mounted on the clamping element and the second lever arm being rotatably mounted on the compression spring. If there is no contact between the current rail and a conductor, i.e. if no clamping force is transferred onto the clamping element, the first lever arm is preferably spaced away or separated from the second lever arm such that there is no connection between the first lever arm and the second lever arm. In this state, the two lever arms can thus be rotated independently of one another. Only when they are transferred into the contacting state are the two lever arms connected to one another in that the first lever arm engages in the second lever arm. In this interconnected state, the first lever arm and the second lever arm are guided to a position forming the contacting state in which the two lever arms form a triangle and the compression spring is tensioned in order to transfer the greatest possible clamping force from the compression spring onto the clamping element via the two lever arms, which are now connected to one another. By applying the clamping force of the preferably particularly strong compression spring onto the clamping element via the two lever arms, a reliable clamping of the conductor by means of the clamping element and thus a reliable contact formation of the conductor with the current rail can be ensured.

According to a preferred configuration of the invention, the clamping element has a clamping arm, which has one or more latches, to clamp the inserted conductor. The clamping element is preferably designed in the form of a clamping lever, one end of which rests on the conductor to be clamped in the contacting state and presses said conductor to the current rail. This end is preferably designed in the form of a clamping arm. In order to improve the clamping action, one or more latches, which hook into the conductor, are preferably formed on the clamping arm. As a result of this, the conductor can be prevented from being released out of the clamped state; in particular an unintentional pulling of the conductor out of the connecting terminal can be prevented.

Furthermore, the clamping element is preferably pivotally mounted on the receptacle body via a first fulcrum. The fulcrum is preferably rotatably fixed in openings formed on the receptacle body and the clamping element is preferably fastened to the fulcrum via a through-opening formed on the clamping element such that it cannot rotate. The clamping element is thus preferably fastened to the receptacle body via the fulcrum. The first lever arm is preferably not fastened directly to the receptacle body but rather via the clamping element to the receptacle body.

The second lever arm is preferably pivotally mounted via a second fulcrum arranged on the receptacle body. This second fulcrum is preferably also rotatably fastened in openings opposite one another on the receptacle body just like the first fulcrum, the openings preferably each being formed as slots such that the second fulcrum together with the second lever arm, which is fixed such that it cannot rotate on the second fulcrum, is displaceable inside the openings such that the second lever arm is movable towards the compression spring in order to tension the compression spring.

The rotatable mounting of the second lever arm on the compression spring is preferably formed by means of a tensioned friction mounting. The mounting between the second lever arm and the compression spring is thus preferably not formed by means of an additional component but rather one of the lateral surfaces of the lever arm preferably rests against a lateral surface of the compression spring such that dynamic friction is formed between the lateral surface of the second lever arm and the lateral surface of the compression spring. The second lever arm is thus preferably movable relative to the compression spring, the second lever arm being pressed against the compression spring in order to tension the compression spring and the second lever arm rotating in the process relative to the compression spring.

Another preferred configuration of the invention provides for the compression spring to be a leaf spring. By using a leaf spring, the compression spring takes up as little space inside the connecting terminal as possible, as a result of which the whole installation space requirement of the connecting terminal can be reduced. Alternatively, however, other compression springs, such as a spiral spring, for example, may also be used.

A particularly preferred arrangement of the compression spring inside the connecting terminal provides for the second lever arm to be pivotally mounted on a first end portion of the compression spring and for the compression spring to be inserted into a recess formed in the receptacle body at a second end portion of the compression spring opposite the first end portion and mounted therein. The second end portion of the compression spring is thus preferably fixed to the receptacle body at a set position in that the second end portion of the compression spring is retained in the recess formed in the receptacle body. The first end portion of the compression spring on the other hand is not arranged in a fixed position, but rather it can be moved relative to the second end portion in order to tension or release the compression spring such that the distance between the first end portion and the second end portion is variable. In order to achieve a particularly space-saving configuration, the compression spring is preferably substantially L-shaped in the process.

In order to clamp the conductor and also to release the clamp, the clamping element preferably has a first tool insertion opening into which a tool, for example a screwdriver, can be inserted. By means of a tool inserted into the tool insertion opening, the clamping element and thus the first lever arm can be rotated about the first fulcrum, whereby the second lever arm is also rotated about the second fulcrum and thus the compression spring can be tensioned and released respectively. As a result, a particularly simple actuation of the connecting terminal is possible for a user.

In this connection, it is also preferably provided for the first lever arm to have a second tool insertion opening, which interacts with the first tool insertion opening of the clamping element. As a result of this, the first lever arm can be actuated directly by a user, as a result of which the exertion of force to tension or release the compression spring and thus to transfer the clamping element into the contacting state or release the clamping element out of the contacting state can be reduced for a user. The operability of the connecting terminal can thus be designed to be particularly user-friendly. The second tool insertion opening is preferably designed in the form of a funnel in order to prevent the tool from being able to slip out of the second tool insertion opening. The first tool insertion opening is then preferably designed in the form of a notch, which acts as a guide for the tool, in order to guide the tool reliably into the second tool insertion opening.

In order to prevent the two lever arms from being guided too far apart when the clamping element is transferred into the contacting state, it is provided according to another preferred configuration of the invention for a stop to be formed on the receptacle body to limit the movement of the first lever arm engaged in the second lever arm during a transfer of the clamping element into the contacting state.

Furthermore, according to an advantageous configuration of the invention, it is provided for interlocking latch devices to fix the clamping element in a position relative to the receptacle body to be formed on the receptacle body and the clamping element. The latch devices can, for example, be designed in the form of recesses formed on the receptacle body into which protrusions formed on the clamping element can engage. The recesses can also be formed on the clamping element and the protrusions on the receptacle body in the process.

The invention is described in more detail hereinafter with reference to a preferred embodiment and the accompanying drawings.

Figure 2:
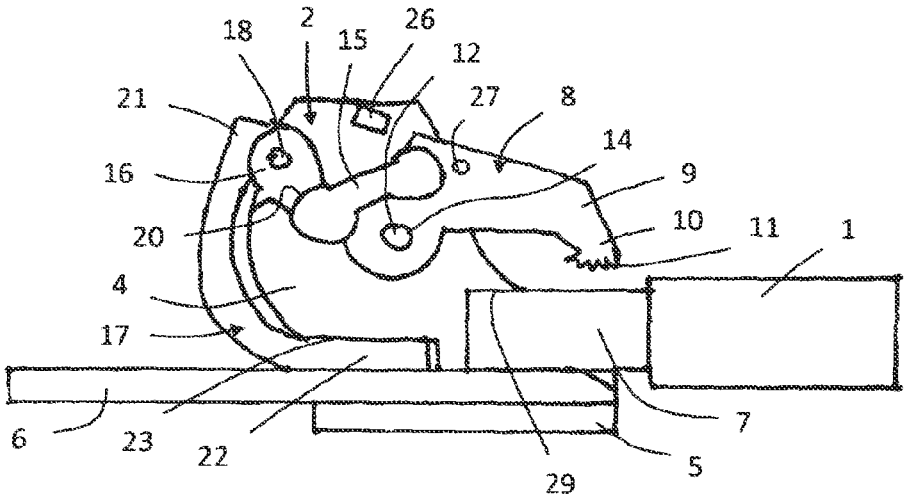
FIG. 2 shows a schematic, partially sectional view of the connecting terminal shown in FIG. 1 according to the invention in a second position.
Figure 3:
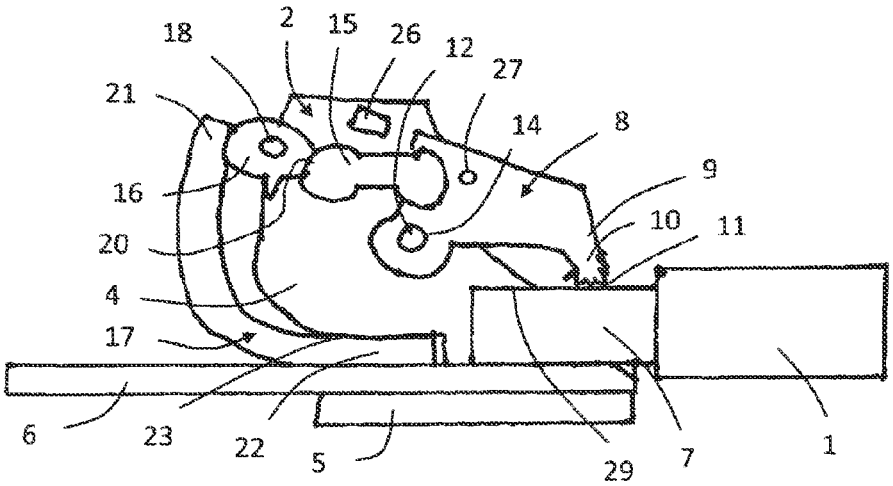
FIG. 3 shows a schematic, partially sectional drawing of the connecting terminal shown in FIG. 1 according to the invention in a third position.
Figure 4:
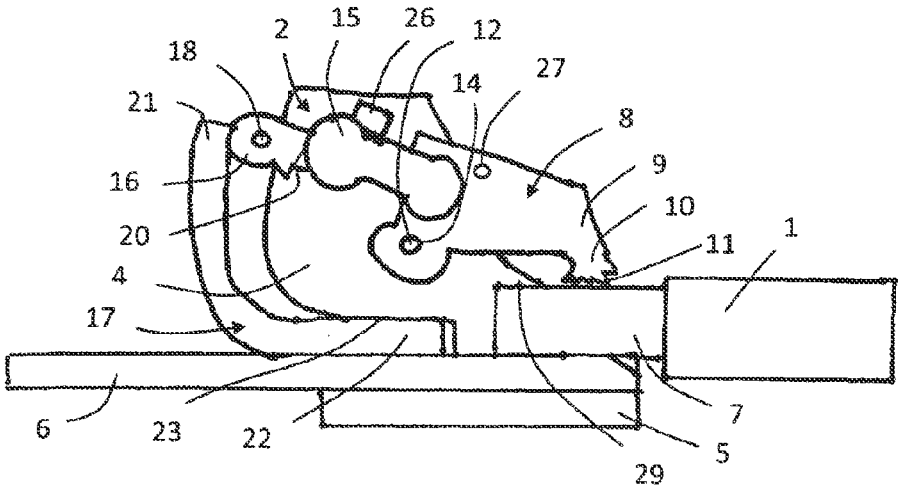
FIG. 4 shows a schematic, partially sectional drawing of the connecting terminal shown in FIG. 1 according to the invention in a fourth position.

In FIGS. 1 to 4, a connecting terminal according to the invention is shown in a schematic and partially sectional side view in four different positions, the transfer of a connecting terminal into a contacting state, as shown in FIG. 4, in order to clamp a conductor 1 inserted into the connecting terminal being shown here.

Figure 5:
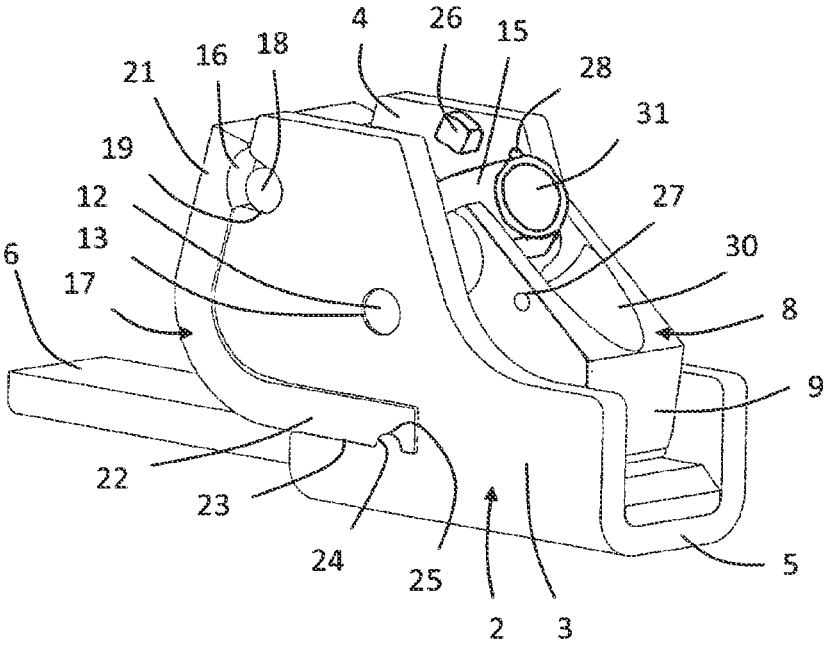
FIG. 5 shows another schematic view of a connecting terminal according to the invention in a perspective view.

The connecting terminal has a receptacle body 2, which, as can be seen in particular in FIG. 5, is substantially U-shaped. The receptacle body 2 has two lateral surfaces 3, 4 arranged parallel to one another, which are connected to one another via a base area 5. A current rail 6, which has been inserted into the receptacle body 2, lies flat on the base area 5. The stripped end 7 of the inserted conductor 1 is clamped onto the current rail 6 in order to form a contact by means of a clamping element 8.

The clamping element 8 is designed in the form of a clamping lever and has a clamping arm 9, on the free end 10 of which a plurality of latches 11 are formed, by means of which the clamping arm 9 can be hooked into the stripped end 7 of the conductor 1 in the contacting state, as shown in FIG. 4. The clamping element 8 is pivotally mounted via a first fulcrum 12 on the two lateral surfaces 3, 4 of the receptacle body 2. In the process, the first fulcrum 12 is rotatably mounted at an opening 13 formed in each of the two lateral surfaces 3, 4 of the receptacle body 2, as shown in FIG. 5, the clamping element 8 being fastened to the first fulcrum 12 via a through-opening 14 formed on the clamping element 8 such that it cannot rotate.

Furthermore, a first lever arm 15 is rotatably mounted above the first fulcrum 12 on the clamping element 8. This first lever arm 15 together with a second lever arm 16 and a compression spring 17 forms an actuator unit in the form of a toggle lever for the clamping element 8 to clamp an inserted conductor 1 by means of the clamping element 8.

The second lever arm 16 is rotatably mounted on the receptacle body 2 via a second fulcrum 18. This second fulcrum 18 is also rotatably mounted at an opening 19 formed in each of the two lateral surfaces 3, 4 of the receptacle body 2 just like the first fulcrum 12, as shown in FIG. 5, the openings 19 preferably being formed as slots such that the second fulcrum 18 together with the second lever arm 16, which is fastened to the second fulcrum 18 such that it cannot rotate, is displaceable inside the openings 19, such that the second lever arm 16 can be moved towards the compression spring 17 in order to tension the compression spring 17, as shown in FIGS. 1 to 4.

The second lever arm 16 has a receptacle surface 20, which is adapted to the outer contour of the first lever arm 15, into which receptacle surface the first lever arm 15 can engage in order to form the contacting state, such that the first lever arm 15 together with the second lever arm 16 can be guided in a rotary movement. In the process, the direction of the rotary movement of the first lever arm 15 is preferably opposite to the direction of rotary movement of the second lever arm 16.

Furthermore, the second lever arm 16 rests on a lateral surface of the compression spring 17 such that the second lever arm 16 is rotatably mounted on the compression spring 17. The rotatable mounting of the second lever arm 16 on the compression spring 17 is formed by a tensioned friction mounting. The mounting between the second lever arm 16 and the compression spring 17 is thus not formed by an additional component such as an additional fulcrum, but rather one of the lateral surfaces of the second lever arm 16 rests on a lateral surface of the compression spring 17 such that dynamic friction is formed between the lateral surface of the second lever arm 16 and the lateral surface of the compression spring 17. In the process, the second lever arm 16 is movable relative to the compression spring 17, the second lever arm 16 being pressed against the compression spring 17 in order to tension the compression spring 17 and the second lever arm 16 rotating relative to the compression spring 17 in the process when the compression spring 17 is expanded and therefore tensioned by the second lever arm 16.

The compression spring 17 is designed in the form of a leaf spring, which is bent substantially into an L-shape. The compression spring 17 has a first free end portion 21 and a second free end portion 22. The first end portion 21 of the compression spring 17 rests against the second lever arm 16. The second end portion 22 of the compression spring 17 is inserted into a recess 23 formed on the receptacle body 2 and fixed therein. In the recess 23, as shown in FIG. 5, one or more latch devices 24 are formed, in the form of a protrusion here, which engages in a recess 25 formed on the compression spring 17, via which the compression spring 17 is fixed inside the receptacle body 2 and thus retained in a permanent position.

Furthermore, the receptacle body 2 has a stop 26 on each of the inner surfaces of the lateral surfaces 3, 4 in the form of a protrusion to limit the movement of the first lever arm 15 engaging in the second lever arm 16 and thus the whole of the actuation unit during the transfer of the clamping element 8 into the contacting state.

Furthermore, as also shown in FIG. 5, interlocking latch devices 27, 28 are provided on the receptacle body 2 and the clamping element 8 to fix the clamping element 8 in a position relative to the receptacle body 2. The latch devices 27, 28 are designed here in the form of recesses 28 formed on the receptacle body 1, in which the protrusions 27 formed on the clamping element 8 can engage. By means of the latch devices 27, 28, the clamping element 8, as shown in FIG. 1, is retained in a first position relative to the receptacle body 2, in which the clamping element 8 is pivoted upwards in order to uncover an insertion opening 29 formed in the receptacle body 2 for the conductor 1 that is to be clamped. The clamping element 8 can thus be prevented from folding down unintentionally when the conductor 1 is inserted or also released without great complexity and in a user-friendly manner.

FIG. 1 shows this first position, in which the clamping element 8, in particular the free end 9 of the clamping element 8, is pivoted upwards and there is no clamping or contact formation with the inserted conductor 1. In this first position, the first lever arm 15 is arranged spaced away from the second lever arm 16 and the compression spring 17 is in a released state and rests as close as possible to the receptacle body 2.

During the transfer into the contacting state, as shown in FIG. 2, firstly the clamping element 8 is lowered downwards towards the conductor 1 inserted into the receptacle body 2. In the process, the first lever arm 15 is pivoted upwards towards the second lever arm 16 until the first lever arm 15 engages in the receptacle area 20 of the second lever arm 16.

Afterwards, as shown in FIG. 3, the first lever arm 15 is pivoted or rotated further upwards together with the second lever arm 16 by a continuing movement of the clamping element 8 downwards towards the conductor 1, the first lever arm 15 continuing to engage in the receptacle area 20 of the second lever arm 16, such that the second lever arm 16 is guided along with the first lever arm 15. During the rotary movement of the second lever arm 16, the second lever arm 16 is moved simultaneously outwards towards the compression spring 17, such that the second lever arm 16 is pressed against the compression spring 17 and the first end portion 21 of the compression spring 17 is bent outwards away from the receptacle body 2, the first lever arm 15 and the clamping element 8, as a result of which the compression spring 17 is tensioned.

In FIG. 4 the contacting state is shown, in which the latches 11 formed on the clamping arm 9 of the clamping element 8 engage in the stripped end 7 of the conductor 1 and, as a result, the stripped end 7 of the conductor 1 is pressed against the current rail 6 and a contact is formed. In the process, the first lever arm 15 is pivoted or rotated upwards to the extent that it rests against the stop 26.

In order to transfer the connecting terminal and the clamping element 8 into the contacting state and also to release the contact, the clamping element 8, as shown in FIG. 5, has a first tool insertion opening 30 to insert a tool, in particular a screwdriver. Furthermore, the first lever arm 15 has a second tool insertion opening 31, which interacts with the first tool insertion opening 30 of the clamping element 8. The first lever arm 15 can be actuated directly by a user through the second tool insertion opening 31, as a result of which the exertion of force to tension or release the compression spring 17 and thus to transfer the clamping element 8 into the contacting state or release the clamping element 8 out of the contacting state can be reduced for a user. The second tool insertion opening 31 is formed in the shape of a funnel in order to prevent the tool from slipping out of the second tool insertion opening 31. The first tool insertion opening 30 is designed in the form of a notch, which acts as a guide for the tool in order to guide the tool reliably into the second tool insertion opening 31, in particular in a position as shown in FIG. 1 and FIG. 4.

In FIG. 5, the connecting terminal shown in FIGS. 1 to 4 is shown without an inserted conductor, the clamping element 8 not being latched onto the receptacle body 2 by means of the latch devices 27, 28 but rather being pivoted downwards onto the current rail 6.

Furthermore, the connecting terminal has a housing, not shown here, into which the receptacle body 2 is inserted together with the components arranged thereon.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS conductor 1
receptacle body 2
lateral surface 3
lateral surface 4
base area 5
current rail 6
stripped end 7
clamping element 8
clamping arm 9
free end 10
latch 11
first fulcrum 12
opening 13
through-opening 14
first lever arm 15
second lever arm 16
compression spring 17
second fulcrum 18
opening 19
receptacle area 20
first end portion 21
second end portion 22
notch 23
latch device 24
recess 25
stop 26
latch device 27
latch device 28
insertion opening 29
first tool insertion opening 30
second tool insertion opening 31

The invention claimed is:

1. A connecting terminal comprising:

a receptacle body;

a clamping element mounted on the receptacle body and configured to clamp a conductor inserted into the connecting terminal against a current rail arranged in the connecting terminal so as to form a contact in a contacting state;

a first lever arm rotatably mounted on the clamping element;

a compression spring mounted on the receptacle body; and a second lever arm rotatably mounted on the compression spring, the second lever arm being configured to engage the first lever arm in the contacting state such that the first and second lever arms are guided together so as to tension the compression spring and transfer a spring force from the compression spring to the clamping element via the first and second lever arms.

2. The connecting terminal as recited in claim 1, wherein the clamping element has at least one clamping arm having latches configured to clamp the inserted conductor.

3. The connecting terminal as recited in claim 1, wherein the clamping element is pivotally mounted via a fulcrum disposed on the receptacle body.

4. The connecting terminal as recited in claim 1, wherein the second lever arm is pivotally mounted via a second fulcrum disposed on the receptacle body.

5. The connecting terminal as recited in claim 1, wherein the rotatable mounting of the second lever arm on the compression spring is provided via a tensioned friction mounting.

6. The connecting terminal as recited in claim 1, wherein the compression spring is a leaf spring.

7. The connecting terminal as recited in claim 1, wherein the second lever arm is rotatably mounted on a first end portion of the compression spring, and a second end portion of the compression spring opposite the first end portion is disposed and mounted in a recess formed in the receptacle body.

8. The connecting terminal as recited in claim 1, wherein the clamping element has a first tool insertion opening.

9. The connecting terminal as recited in claim 8, wherein the first lever arm has a second tool insertion opening interacting with the first tool insertion opening of the clamping element.

10. The connecting terminal as recited in claim 1, wherein a stop is formed on the receptacle body so as to limit the movement of the first lever arm engaging the second lever arm when the clamping element transfers into the contacting state.

11. The connecting terminal as recited in claim 1, wherein interlocking latch devices are disposed on the receptacle body and the clamping element, the interlocking latch devices being configured to fix the clamping element in a position relative to the receptacle body.

* * * * *